US005474243A

United States Patent [19]

Schwelling

[11] Patent Number: 5,474,243

[45] Date of Patent: Dec. 12, 1995

[54] STRIPPING SYSTEM OF A CUTTING MECHANISM FOR A PAPER SHREDDER

[76] Inventor: Herman Schwelling, Hartmannweg 5, D-88682 Salem, Germany

[21] Appl. No.: 273,086

[22] Filed: Jul. 11, 1994

[30] Foreign Application Priority Data

Jul. 20, 1993 [DE] Germany ..... 43 24 282.0

[51] Int. Cl.[6] ..... B02C 18/18

[52] U.S. Cl. ..... 241/166; 241/236

[58] Field of Search ..... 241/166, 167, 241/236

[56] References Cited

U.S. PATENT DOCUMENTS

| | | | |
|---|---|---|---|
| 4,018,392 | 4/1977 | Wagner | 241/167 |
| 4,489,897 | 12/1984 | Turner et al. | 241/167 |
| 4,562,971 | 1/1986 | Schwelling | 241/236 |
| 4,688,730 | 8/1987 | Dahle | 241/166 |
| 4,773,603 | 9/1988 | Schwelling | 241/167 |
| 4,809,916 | 3/1989 | Schwelling | 241/166 |
| 5,375,782 | 12/1994 | Schwelling | 241/166 |

*Primary Examiner*—Timothy V. Eley
*Assistant Examiner*—John M. Husar
*Attorney, Agent, or Firm*—Anderson Kill Olick & Oshinsky

[57] ABSTRACT

A cutting mechanism for a paper shredder includes a pair of cutting rollers, two pairs of stripping plates associated with the pair of cutting rollers, respectively, and arranged between respective cutting discs of cutting rollers, and a plurality of rods extending in the stripping plates for supporting same, with the stripping plates being arranged in upper and lower portions of the cutting mechanism with a clearance between adjacent plates, which clearance can be varied within a relatively large range.

3 Claims, 2 Drawing Sheets

STRIPPING SYSTEM OF A CUTTING MECHANISM FOR A PAPER SHREDDER

BACKGROUND OF THE INVENTION

The present invention relates to a cutting mechanism for a paper shredder including a pair of cutting rollers, two pairs of stripping plates associated with the cutting rollers and arranged between respective cutting discs of the pair of rollers, and a plurality of rods extending between side support plates of the cutting mechanism and through the stripping plates for supporting the same.

A cutting mechanism of the above-described type is disclosed, e.g., in German publication DE OS 36 10 537 of the Applicant herein. The known cutting mechanisms generally function rather satisfactory, and their major drawback is a large number of stripping plates, which are used. The large number of stripping plates results in an increased weight and increased production costs caused by a necessity to use as a large number of stripping plates so rather heavy supporting rods.

Accordingly, the object of the invention is a stripping system for a cutting mechanism of a paper shredder having a reduced number of stripping plates with, thereby, a reduced stripping force applied to the plate supporting rods.

SUMMARY OF THE INVENTION

This and other objects of the invention, which will become apparent hereinafter, are achieved by providing stripping plates which are arranged in the upper and lower portions of the cutting mechanism as single plates or in groups of two or more plates with a clearance between adjacent stripping plates and with clearance widths between adjacent plates varying in a relatively large range.

BRIEF DESCRIPTION OF THE DRAWINGS

The features and objects of the present invention will become more apparent, and the invention itself will be best understood from the following detailed description of the preferred embodiment, when read with reference to the accompanying drawings, wherein.

DETAILED DESCRIPTION OF THE PREFERRED EMBODIMENT

Figure 1:
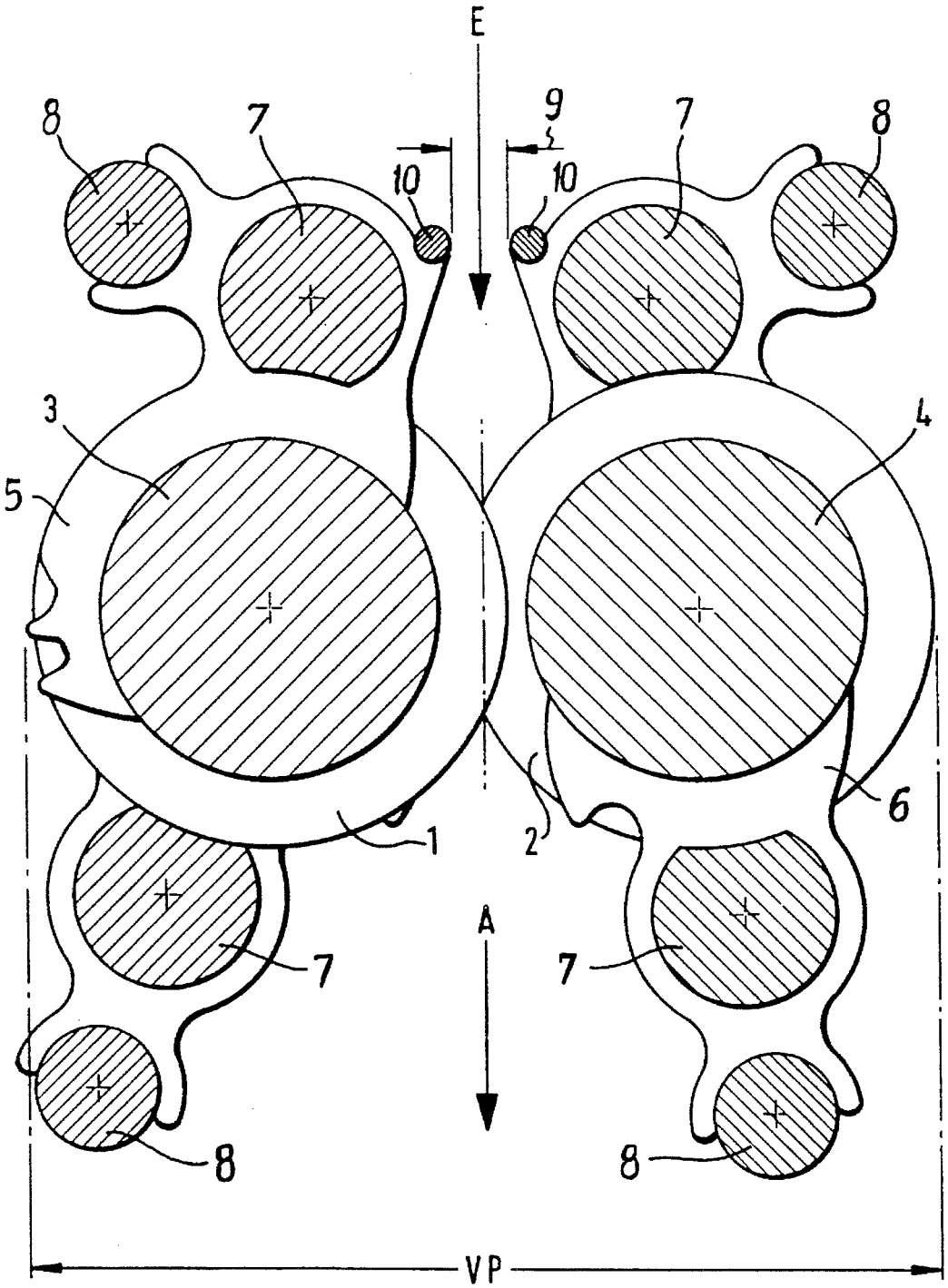
FIG. 1 is a cross-sectional view of a cutting mechanism according to the present invention.
Figure 2:
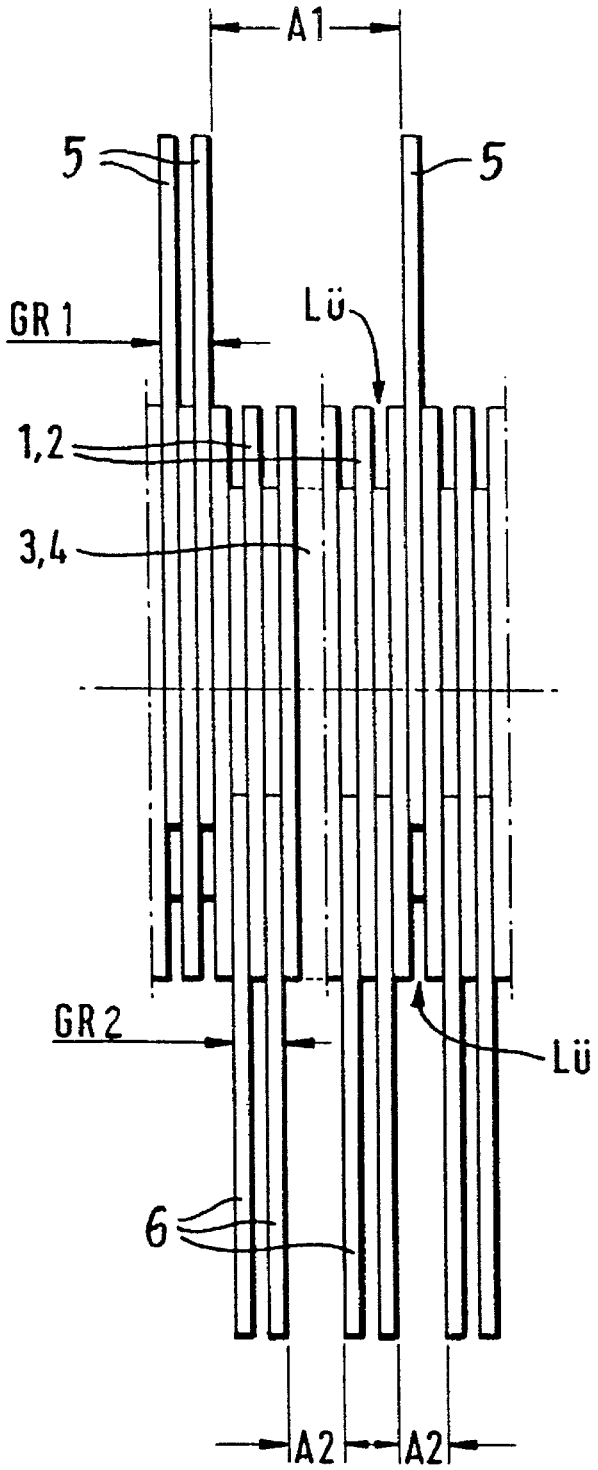
FIG. 2 is a partial side view of the mechanism shown in FIG. 1

FIG. 1 shows a cutting mechanism for a paper shredder including a pair of cutting rollers 1, 3 and 2, 4 and associated therewith, respectively, pairs stripping plates 5 and 6 extending between the cutting discs 1 and 2 up to cores 3 and 4, respectively. The stripping plates 5 and 6 are supported on rods 7 and 8 extending therethrough.

According to the invention, the stripping plates 5 and 6 are arranged at the upper and lower sides of the cutting mechanism either as separate plates or are combined in groups of two or more plates $GR_1$ and $GR_2$ defining a clearance therebetween. The clearance widths A1 and A2 between separate plates or groups of plates can be varied in a large range.

According to the invention, it is further provided that the base portions of the stripping plates 5 and 6 extend on the upper side of the cutting mechanism up the shredder inlet 9 in a shrouding cover (not shown). At the shredder inlet 9, the stripping plates 5, 6 are connected with finger guard rods 10. The entire stripping system is arranged within the vertical plane of cutting rollers 1, 3 and 2, 4.

The structure of the cutting mechanism described above results in the reduced weight thereof and permits to reduce the costs of manufacturing the cutting mechanism. The cutting mechanism according to the invention permits to reduce in half the number of stripping plates. Moreover, the stripping plate supporting rods, because of a reduced stripping force acting thereon, can be made significantly lighter.

While the present invention was shown and described with reference to a preferred embodiment, various modification thereof will be apparent to those skilled in the art and, therefore, it is not intended that the invention be limited to the disclosed embodiment and/or details thereof, and departure may be made therefrom within the spirit and scope of the appended claims.

What is claimed is:

1. A cutting mechanism for a paper shredder, comprising:

a pair of cutting rollers each having a cutting disc and a core;

two pairs of stripping plates associated with the pair of cutting rollers, respectively, and arranged between respective cutting discs;

a plurality of rods extending in the stripping plates for supporting same;

wherein, the stripping plates are arranged in upper and lower portions of the cutting mechanism with a varying clearance between adjacent plates, and wherein, the upper stripping plates have base portions extending to an inlet of the shredder, the cutting mechanism further comprising finger guard rods defining the inlet and to which the stripping plates are connected at the inlet.

2. A cutting mechanism as set forth in claim 1, wherein groups of at least two stripping plates are arranged on the opposite sides of the cutting discs, respectively, instead of single stripping plates, with a clearance between stripping plates within a group being different from a clearance between groups of stripping plates.

3. A cutting mechanism as set forth in claim 1, wherein the stripping plates are located within a vertical plane of the cutting rollers.

* * * * *